US009708808B2

(12) United States Patent
Stanaland

(10) Patent No.: US 9,708,808 B2
(45) Date of Patent: Jul. 18, 2017

(54) TRAP PRIMER

(71) Applicant: Jay R. Smith Mfg. Co., Montgomery, AL (US)

(72) Inventor: William A. Stanaland, Montgomery, AL (US)

(73) Assignee: Jay R. Smith Manufacturing Company, Montgomery, AL (US)

( * ) Notice: Subject to any disclaimer, the term of this patent is extended or adjusted under 35 U.S.C. 154(b) by 133 days.

(21) Appl. No.: 14/545,559

(22) Filed: May 21, 2015

(65) Prior Publication Data

US 2016/0340885 A1 Nov. 24, 2016

(51) Int. Cl.
*E03C 1/296* (2006.01)
*E03F 5/04* (2006.01)

(52) U.S. Cl.
CPC ..... *E03F 5/041* (2013.01); *E03C 1/296* (2013.01); *E03F 5/0407* (2013.01); *Y10T 137/266* (2015.04)

(58) Field of Classification Search
CPC ..... E03C 1/296; E03F 5/0407; E03F 5/041; Y10T 137/2652; Y10T 137/266; Y10T 137/2663
USPC ..... 137/118.02, 118.05, 118.06
See application file for complete search history.

(56) References Cited

U.S. PATENT DOCUMENTS 1,759,826 A * 5/1930 Goss ..... E03C 1/296 137/118.02
1,967,644 A * 7/1934 Williams ..... F16K 51/00 137/118.02
2,233,818 A * 3/1941 Matter ..... F16K 31/36 137/512.2
3,333,597 A * 8/1967 Sullivan ..... E03C 1/296 137/102
3,776,269 A 12/1973 Watts
4,000,752 A 1/1977 Miller et al.
4,204,556 A * 5/1980 Sullivan ..... E03C 1/296 137/204
4,497,337 A 2/1985 Mosbrucker et al.
5,287,877 A 2/1994 Ackroyd
6,152,164 A 11/2000 Whiteside
6,283,442 B1 9/2001 Whiteside
6,325,091 B1 12/2001 Perrott et al.
6,422,260 B2 7/2002 Danowski et al.
7,520,292 B2 4/2009 Weltman
8,671,970 B2 3/2014 Vilendre et al.
2001/0037826 A1* 11/2001 Danowski ..... E03C 1/296 137/247.25

(Continued)

*Primary Examiner* — William McCalister

(74) *Attorney, Agent, or Firm* — Eric J. Sosenko; Jonathan P. O'Brien; Honigman Miller Schwartz and Cohn LLP

(57) ABSTRACT

An embodiment providing one or more improvements includes a trap primer with upper and lower chambers separated by a flexible diaphragm which also interacts with a valve stem to start and stop the flow of water from the trap primer to the trap(s). The lower chamber contains a polymeric foam medium such as a foam ring containing closed cells containing gas or gases. In use, equilibration of water pressures in the upper and lower chambers causes distortion of the foam ring, resulting in equilibration of the gas pressure in the closed cells with that of the chambers. A decrease in line water pressure causes water from the lower chamber to be emitted into the traps.

14 Claims, 12 Drawing Sheets

(56) References Cited

U.S. PATENT DOCUMENTS

| | | | | |
|---|---|---|---|---|
| 2007/0209707 | A1* | 9/2007 | Weltman | E03C 1/296<br>137/247.25 |
| 2007/0277880 | A1* | 12/2007 | Vilendre | E03C 1/296<br>137/247.25 |

* cited by examiner

TRAP PRIMER

BACKGROUND OF THE INVENTION

Field of the invention

This invention relates to drain trap primers in which a gas under pressure is utilized to displace a liquid and a definite coaction exists between the gas and liquid which affects the system.

BRIEF SUMMARY OF THE INVENTION

Drain traps are essential in preventing the entry of poisonous sewer gas into buildings. Such traps are essentially U-shaped portions of drain pipes which fill with water from the drain and thereby prevent passage of sewer gasses from a sewer into the drain and into the building. Unfortunately, when the drains are used only infrequently, the water in the traps tends to evaporate, thus exposing the users of the building to sewer gasses.

Trap primers periodically replenish the water level in the drain traps and prevent the drying through evaporation of drain traps. Prior art trap primers replenish the drain traps using water from a building's water supply pipe. Such primers release water to the drain traps in response to fluctuations in the pressure in the supply pipe, which result from a draw on water from the supply pipe, such as opening a faucet, or flushing a toilet.

Some prior art trap primers contain chambers containing compressed air at a pressure which equilibrates with the water pressure in the supply pipe. When the water pipe pressure momentarily fluctuates, the compressed air opens a valve which allows water to flow from the trap primer into the trap or traps. In some prior art trap primers in which water is in contact with the compressed air, there is a tendency for the air to dissolve into the water, thereby reducing the volume of compressed air with an increase in the volume of water in the air chamber, until the primer fails to function properly. In other prior art primers the compressed air is separated from the water by a moving piston. Such arrangements are susceptible to binding and malfunction of the moving parts due to water borne residues and corrosion of the parts.

In embodiments of the present application compressed gas in closed-cell polymeric foam, in combination with a anti-oscillation valve, is used to open a membrane to valve in response to fluctuation of water supply pressure. Embodiments include an optional cleaner probe. Embodiments include an optional distributor to serve a multiplicity of water traps. Embodiments provide trap primers which are reliable, inexpensive, and easy to manufacture.

Embodiments include a trap primer for maintaining water levels in a drain trap in a building having a water supply line comprising a connection to the building water supply line, an upper chamber, an anti-oscillating valve located between the supply line and the upper chamber, a lower chamber having a bottom and a circumferential upper edge, the upper and lower chambers separated by a flexible diaphragm, a valve stem extending vertically from the bottom to the upper edge of the lower chamber, the valve stem having a bore with an orifice at the upper end, and a port leading to a trap at the lower end, the diaphragm reversibly sealing the valve stem orifice, and a closed-cell polymeric foam medium, the cells containing a gas, the foam medium located in the lower chamber.

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

In this disclosure the term "resilient gas enclosure" (RGE) means material manufactured of a resilient polymer containing a gas. When the RGE takes the form of a foam, such materials comprise independent, non-communicating cells of a resilient polymeric material, such as a polyurethane, polyvinyl chloride, polystyrene, polyimide, or silicone. When the RGE takes the form of a foam, cells in the foam are formed during manufacturing using blowing agents, such as $CO_2$, $N_2$, or air. A suitable RGE closed-cell polymer foam is polyurethane with closed cells containing $CO_2$ gas. In embodiments, the RGE takes the form of a hollow, gas containing sealed structure with impermeable resilient walls made of suitable polymers, such as those listed above and containing a gas or gasses as described above. Such an embodiment is termed a "bubble chamber".

Figure 1:
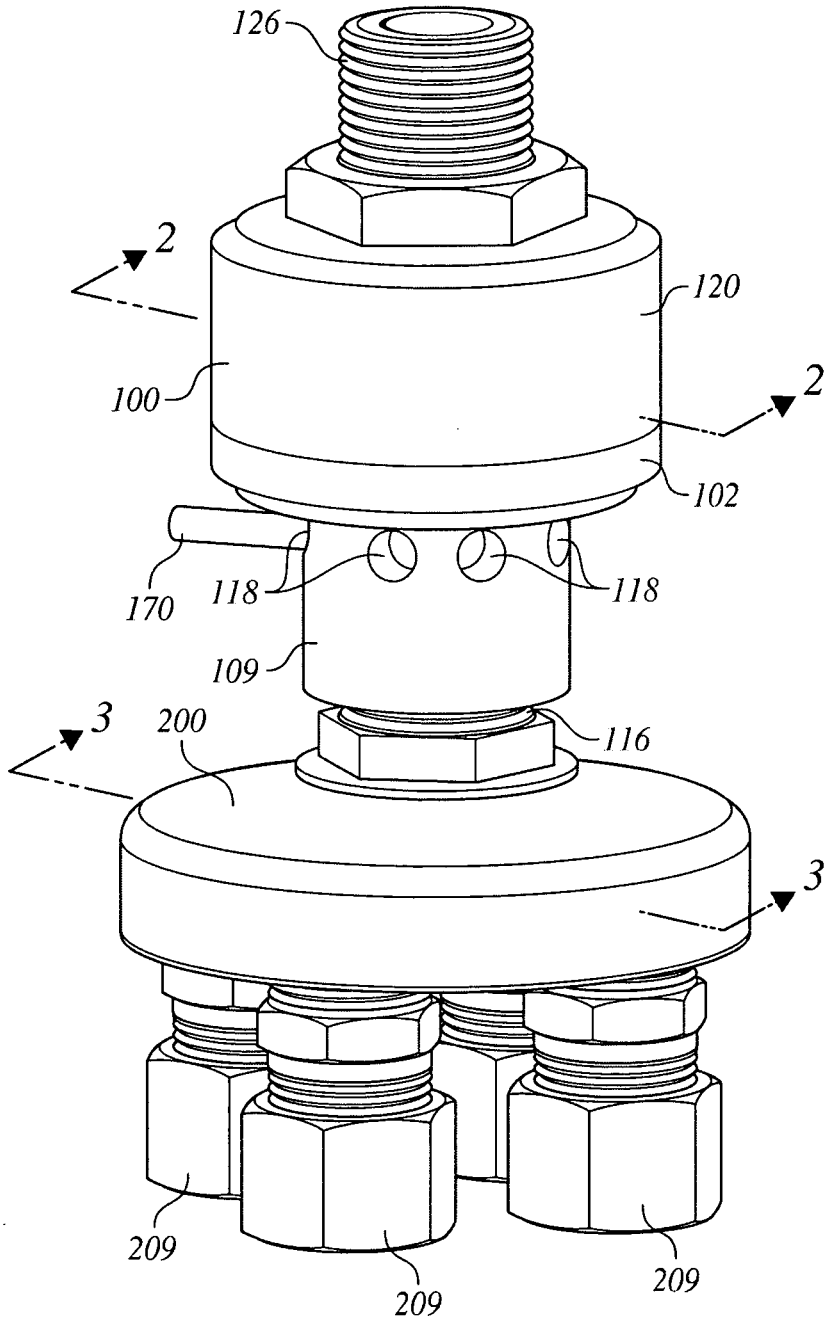
FIG. 1 is a perspective view of an embodiment trap primer with optional attached outlet distributor.

FIG. 1 is a perspective view of an embodiment cylindrical trap primer 100 with optional attached cylindrical outlet distributor 200. An inlet 126 is provided for attachment to the building water supply pipe (not shown in FIG. 1). The inlet is attached to the upper body 120, which is reversibly attached to the lower body 102. Vent holes 118 are arrayed about the lower body neck 109. An optional cleaning lever 170 which extends through a vent hole is visible in FIG. 1. An outlet 116 is attached to the bottom of the neck 109. An optional outlet distributor 200 is attached to the outlet 116. A multiplicity of trap supply outlets 209 are used to connect pipes to supply water to a multiplicity of traps (not show in FIG. 1).

Figure 2:
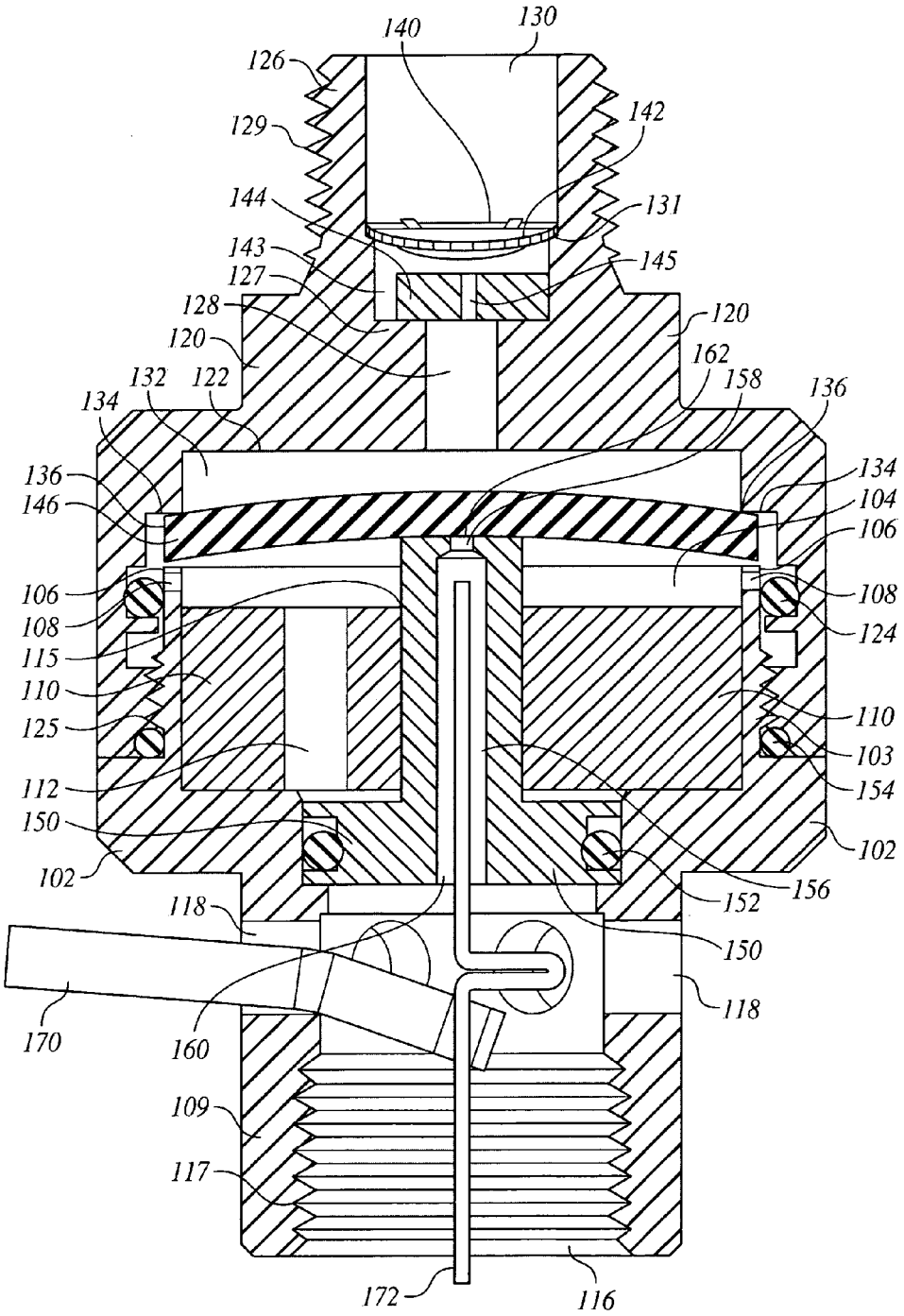
FIG. 2 is a cross-sectional view of the embodiment trap primer of FIG. 1 taken at line 2-2.

FIG. 2 is a cross-sectional view of the embodiment trap primer of FIG. 1 taken at line 2-2. Visible in FIG. 2. is the cylindrical upper body inlet 126 with external screw connector 129 for connection to a water supply pipe (not shown in FIG. 2) and an inlet bore 130 for the passage of water into the trap primer. A circular disk-like filter 142 rests on the circular bore shoulder 131 on the inlet bore 130 and is held in place by a filter retainer 140. A disk-like anti-oscillation valve disc 144 with a valve disc center orifice 145 rests on an inlet shoulder 127. The combination of inlet bore 130, inlet bore shoulder 131, filter screen 142, and anti-oscillation valve disc 144 is referred to as an anti-oscillation valve 143.

The inlet 126 is attached to the cylindrical upper body 120. The inlet bore 130 leads to the upper body bore 128. The Upper body bore 128 penetrates the center of the circular flat upper chamber ceiling 122. Flow of water into the upper body bore 128 is controlled by the check valve bore 145. The upper body bore 128 leads to a cylindrical upper chamber 132. There is a circumferential upper body shoulder 134 which runs around the upper chamber 132. A circular disk-like flexible diaphragm 146 is located below the upper body shoulder 134. An inlet check valve 136 is formed when the upper edges of the diaphragm 146 are pressed against the upper body shoulder 134. A lower chamber 104 is located below the diaphragm 146.

The upper body 120 is reversibly connected to the lower body 102 by screw threads 125 and 103, respectively. A first embodiment RGE made of closed-cell polymeric medium termed a foam ring 110 rests in the lower chamber 104. A center hole 115 extends through the center of the foam ring 110. The valve stem 150 protrudes through the center hole 115. A multiplicity of foam ring holes 112 penetrate the foam ring 110. The circular lower chamber rim 106 is located at the top of the lower body 102. A multiplicity of holes 108 are arrayed below the lower chamber rim 106. Additional details on the lower chamber rim are found in FIG. 9. A valve stem 150 extends through the lower chamber 104 and is attached to the lower body 102. A valve stem bore 156 extends through the valve stem with the valve stem orifice 158 at the upper end of the bore and valve stem port 160 at the lower end of the bore. The diaphragm 146 reversibly blocks the valve stem orifice 158 forming the trap primer outlet valve 162.

A lower body neck 109 is attached to the bottom of the lower body 102. A multiplicity of vent holes 118 are arrayed about the lower body neck 109. The vent holes 118 act as vacuum breakers which prevent backflow of water from an outlet distributor or trap pipe and allow observation of the flow of water from the valve stem port 160. An outlet bore 116 receives water from the valve stem port 160. Screw threads 117 on the interior of the outlet bore 116 are used for reversible connection with a optional outlet distributor (see FIG. 3) or with a pipe leading to an individual trap. FIG. 2 shows the optional cleaning lever 170 which is attached to the optional cleaning probe 172 which extends through the valve stem bore 156 up to the valve stem orifice 158.

Figure 3:
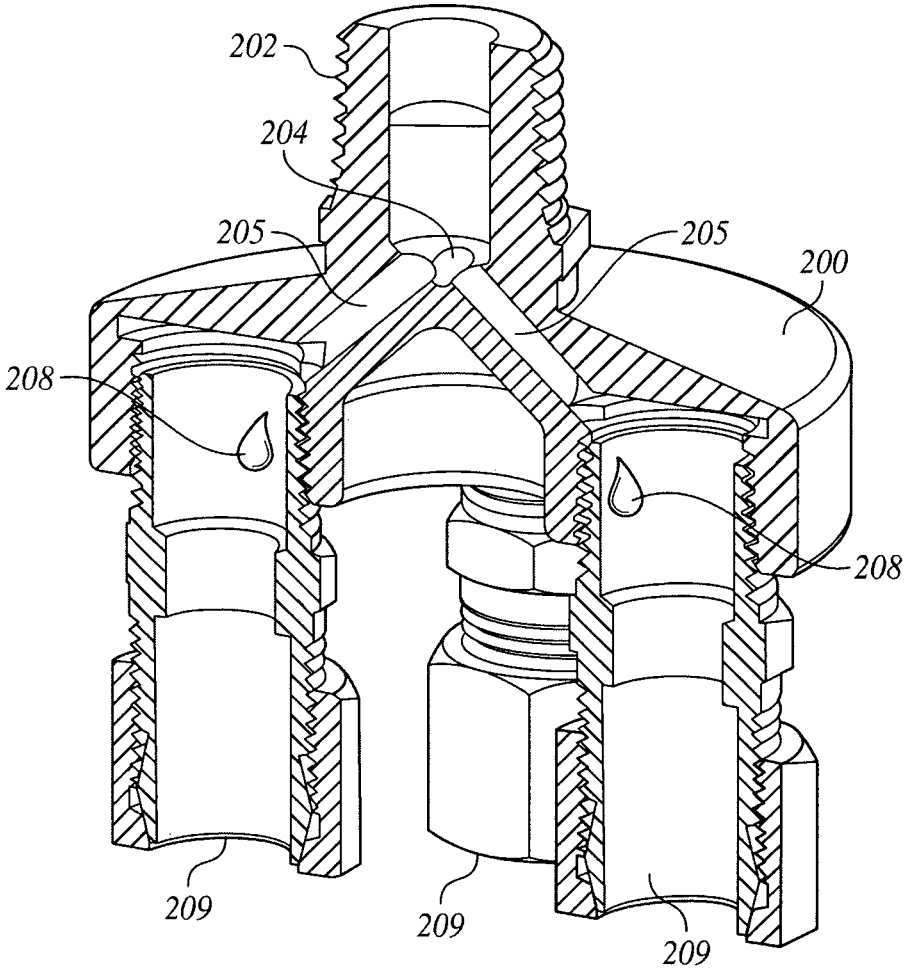
FIG. 3 is a cross-sectional view of the embodiment outlet distributor of FIG. 1 taken at line 3-3.

FIG. 3 is a cross-sectional view of the embodiment outlet distributor 200 of FIG. 1 taken at line 3-3. The distributor inlet 202 receives water from the outlet of the trap primer (not shown in FIG. 3). The flow of water enters the flow divider 204 where the flow is divided into each of a multiplicity of distributor bores (four bores in the embodiment of FIG. 3) and the flow 208 descends into the trap supply outlets 209. Pipes connected to the outlets lead to the individual traps which are served by the trap primer (not shown in FIG. 3).

Figure 4:
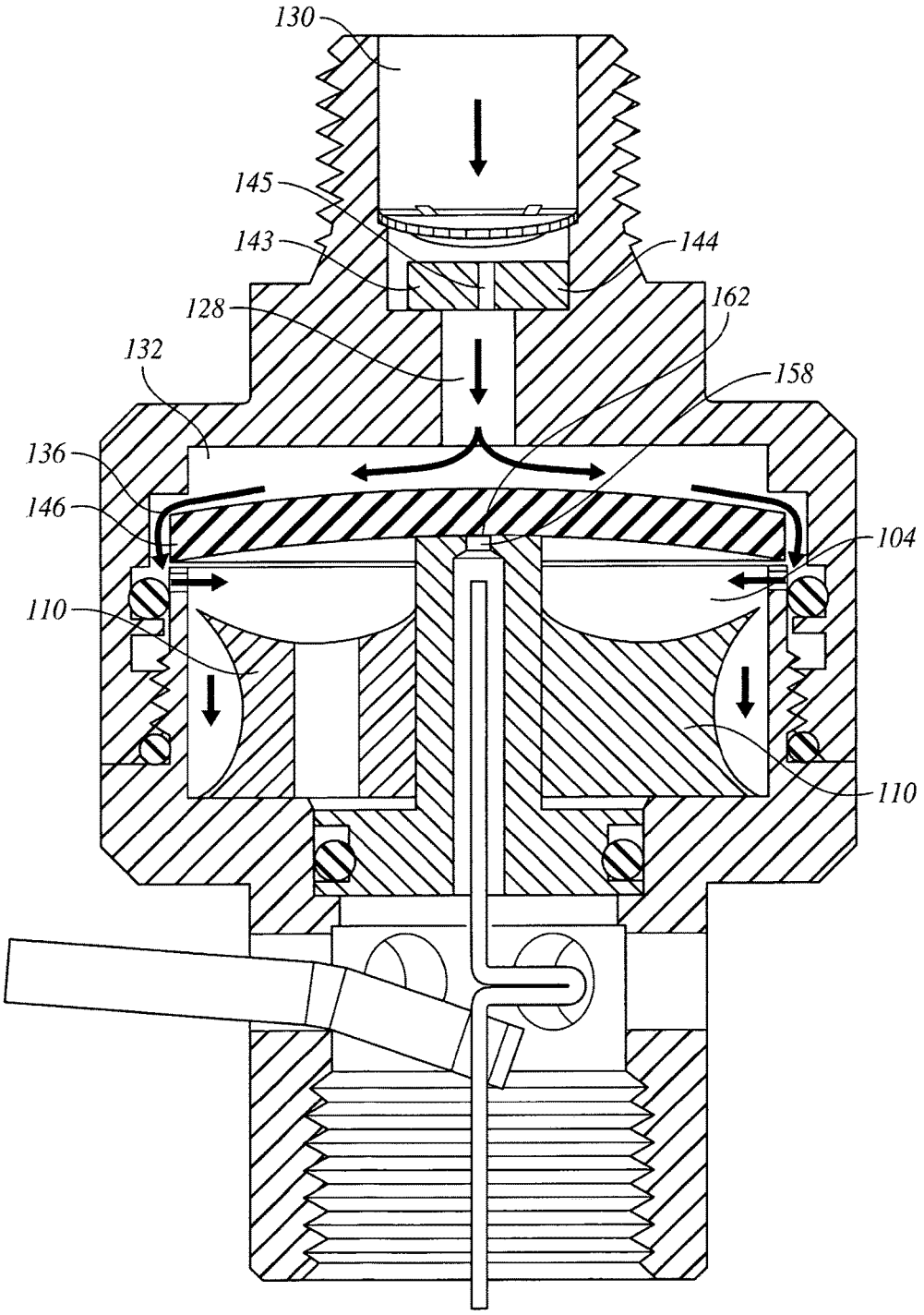
FIG. 4 is a cross-sectional view of the embodiment trap primer of FIG. 1 taken at line 2-2 showing the start-up of the trap primer.

FIG. 4 is a cross-sectional view of the embodiment trap primer of FIG. 1 taken at line 2-2. FIG. 4 shows the start-up of the trap primer. The elements of FIG. 4 are the same as in FIG. 2. The flow of water is indicated by arrows. In start-up, water flows into the inlet bore 130 and through the center orifice 145 of the anti-oscillation valve disc 144. The anti-oscillation valve 143 under these conditions is termed "closed". The water passes through the upper body bore 128, and into the upper chamber 132. The pressure of the water at line pressure closes the trap primer outlet valve 162 by pressing the diaphragm 146 against the valve stem orifice 158. Water flows through the now open inlet check valve 136 and enters and fills the lower chamber 104. The line pressure of the water compresses the gas within the closed cells of the polymeric foam ring 110 thereby compressing and distorting the RGE foam ring itself until the pressure within the closed cells within the foam ring equilibrates with the pressure in the water supply line.

Figure 5:
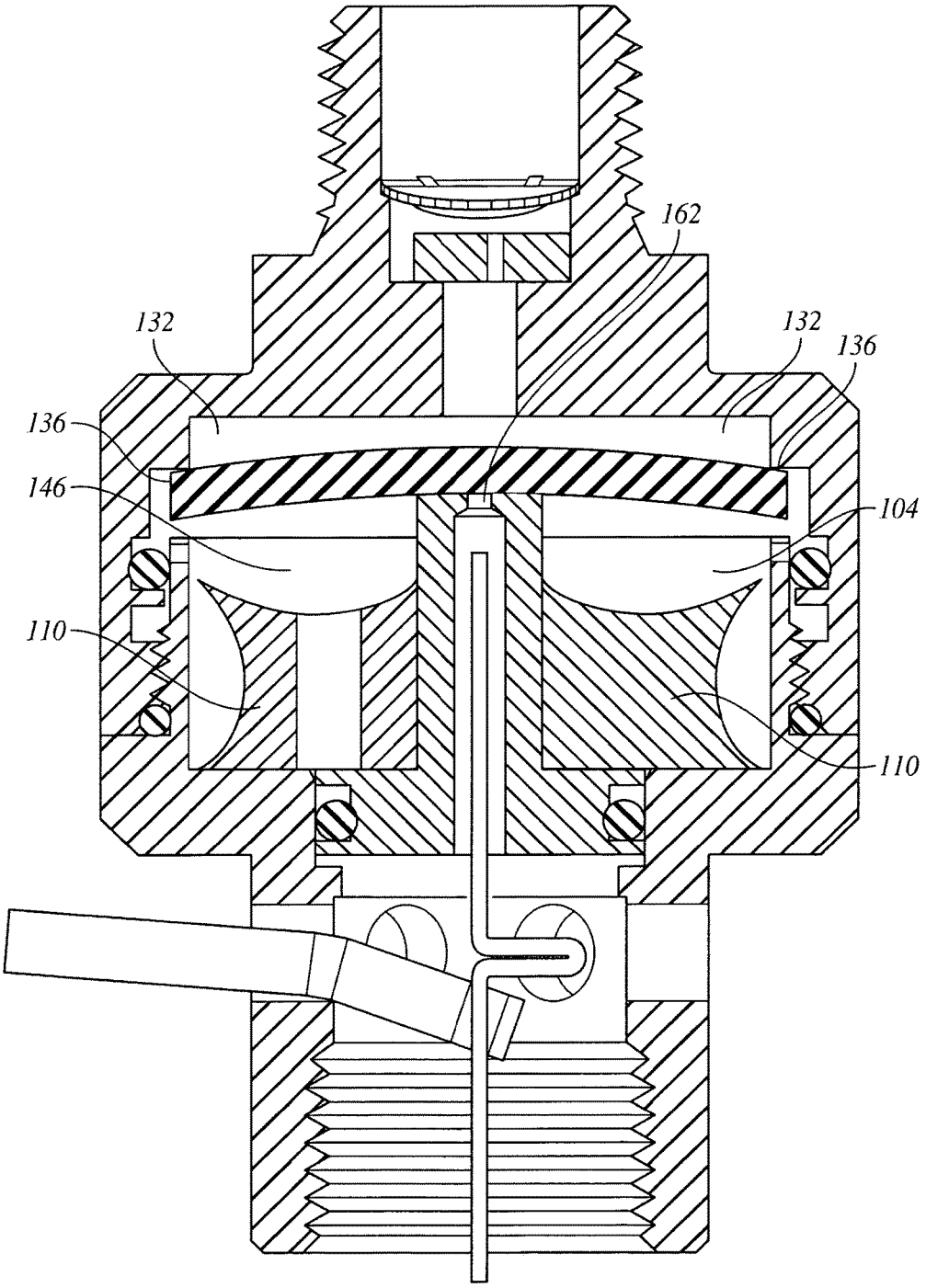
FIG. 5 is a cross-sectional view of the embodiment trap primer of FIG. 1 taken at line 2-2 showing the trap primer under conditions of stable line pressure.

FIG. 5 is a cross-sectional view of the embodiment trap primer of FIG. 1 taken at line 2-2. FIG. 5 shows the trap primer under conditions of stable line pressure. The elements of FIG. 5 are the same as in FIG. 2. Note that the inlet check valve 136 is now closed, as is the trap primer outlet valve 162. The water pressures in both the upper 132 and the lower 104 chambers are the same. The gas pressure within the closed cells of the RGE polymeric foam medium or foam ring 110 is equilibrated at the same pressure as that of the water in the upper 132 and lower 104 chambers. There is no flow in or out of the trap primer. It should be noted that the trap primer outlet valve opens and closes after a reduction in line pressure and before the increase in pressure to the start-up condition. The trap primer outlet valve will react to a further drop in pressure by opening and closing, even if the original line pressure is not yet restored.

Figure 6:
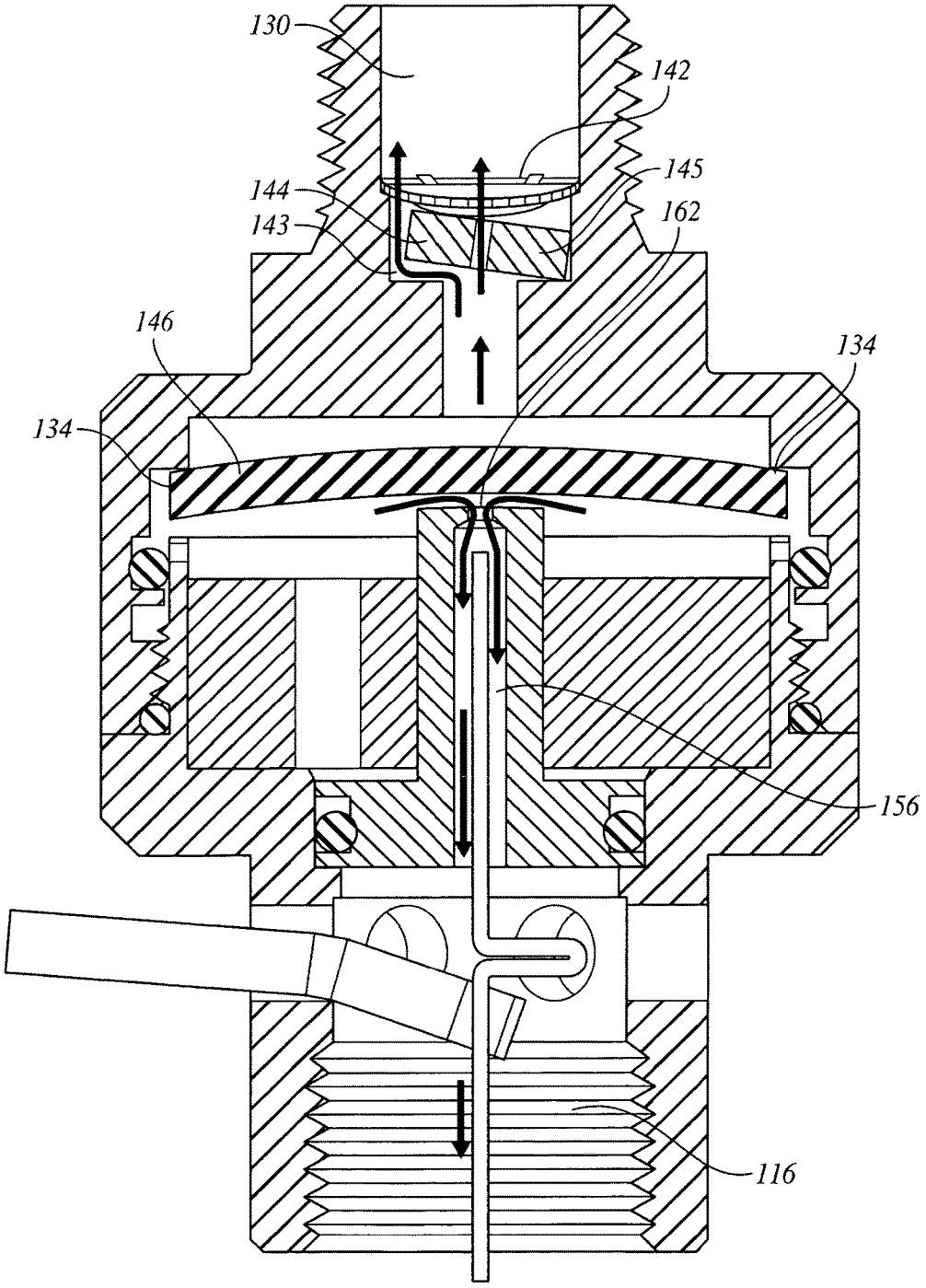
FIG. 6 is a cross-sectional view of the embodiment trap primer of FIG. 1 taken at line 2-2 showing the behavior of the trap primer when there is a decrease in the line pressure.

FIG. 6 is a cross-sectional view of the embodiment trap primer of FIG. 1 taken at line 2-2. FIG. 6 shows the behavior of the trap primer when there is a decrease in the line pressure. The elements of FIG. 6 are the same as in FIG. 2. Flow from the trap primer is activated by a decrease in line water pressure, as accompanies the opening of a faucet or the flushing of a toilet. When the pressure drops, water flows from the upper chamber 132 through the anti-oscillation valve 143 into the inlet bore 130. Such flow is through the anti-oscillation valve disc orifice 145 and around one edge of a tilted anti-oscillation valve disc 144. The filter screen 142 prevents the anti-oscillation valve disc 144 from being pushed by the flow of water out of the trap primer into the water supply pipe. Such flow develops because the pressure in the lower chamber, at the previously high level, causes flexing of the diaphragm 146 with simultaneous closing the inlet check valve 134, thereby maintaining separation of water between the upper and lower chambers by the diaphragm. Simultaneously with the flexing of the diaphragm is the opening of the trap primer outlet valve 162, allowing the flow of water through the valve stem bore 156 into the outlet bore 116 and ultimately to the trap or traps. The impetus for the flexing of the diaphragm is the gas within the closed pores of the RGE foam ring 110, which was previously equilibrated at the relatively higher line pressure. The distortion of the ring is relieved as the pressure of the gas within the closed pores reaches the new lower pressure of the supply line. The resumption of the original volume of the foam ring accompanies and is the impetus for the flow of water from the trap primer. When the faucet is closed or water closet replenished the higher pressure in the water supply line is reestablished and the start-up condition show in FIG. 4 is assumed.

It should be noted that the anti-oscillation valve disc allows flow through the anti-oscillation valve disc center orifice only when water is flowing from the water supply line into the trap primer (see FIG. 4). When water flow is reversed, from the trap primer into the water supply line (see FIG. 6), there is flow both through the disc center orifice and, because the valve tilts, around the side of the valve. The delay of water flow from the water supply through the anti-oscillation valve disc orifice has the important effect of delaying the recompression of the RGE foam ring for a fraction of a second. This prevents trap primer oscillation due to water hammer effect. In the absence of an anti-oscillation valve disc the trap primer has a tendency to oscillate from the open to the closed mode. This anti-oscillation valve design allows very low pressure drop sensitivity in the trap primer valve design, observed to be as low as 0.25 psi.

Figure 7:
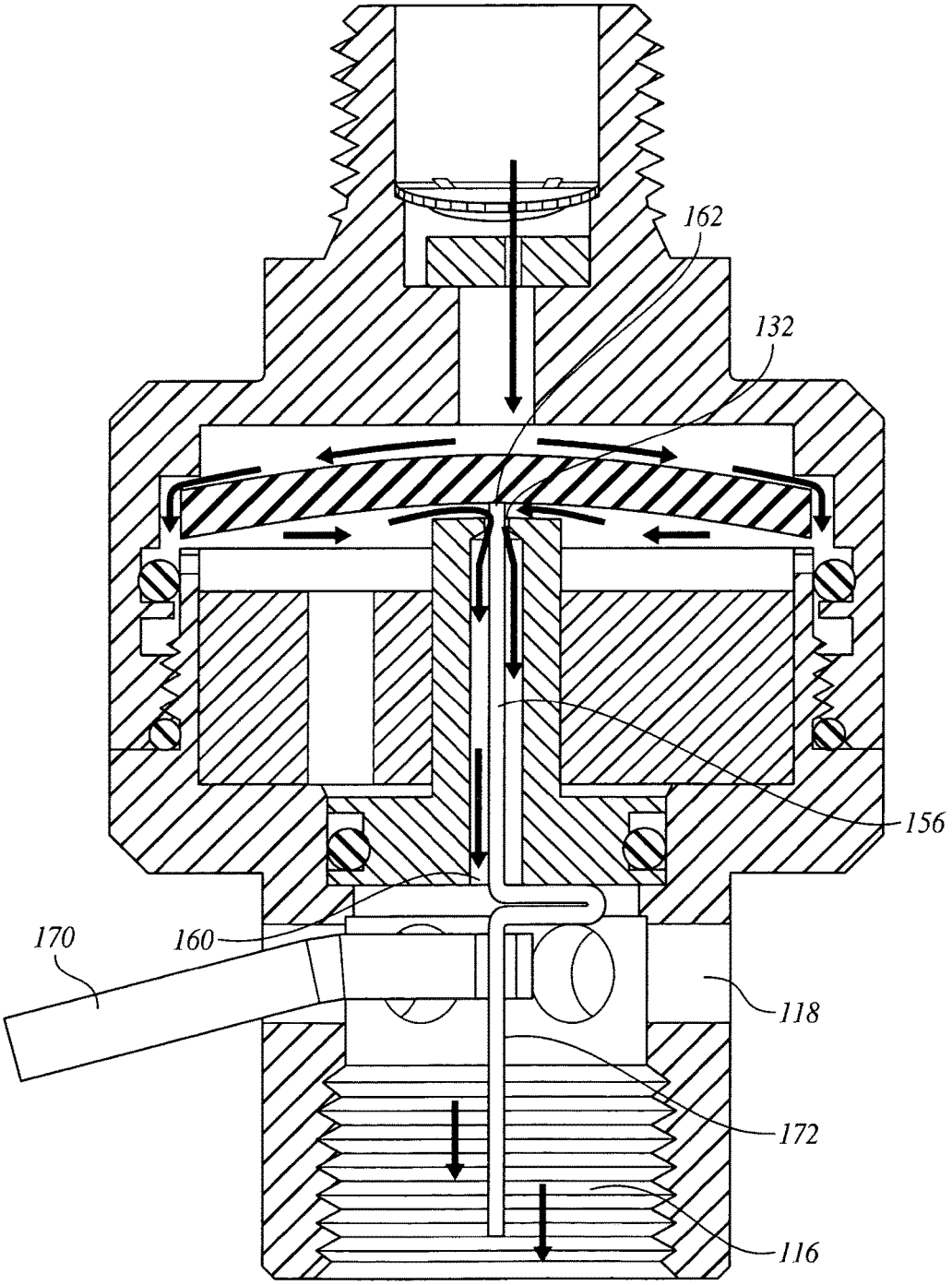
FIG. 7 is a cross-sectional view of the embodiment trap primer of FIG. 1 taken at line 2-2 with the cleaning lever and probe showing the action of the cleaning lever and probe.

FIG. 7 is a cross-sectional view of the embodiment trap primer of FIG. 1 taken at line 2-2 with the cleaning lever and probe. FIG. 7 shows the action of the cleaning lever and probe. The elements of FIG. 7 are the same as in FIG. 2. Pressing down on the cleaning lever 170 raises the cleaning probe 172 thereby cleaning the valve stem bore 156 and valve stem orifice 158. Raising the cleaning probe also opens the trap primer outlet valve 162 allowing water to flow through the valve stem orifice 158, into the valve stem bore 156, out the valve stem port 160, and through the outlet bore 116 thereby simulating the function of the trap primer under conditions of reduced line pressure. The flow of water from the valve stem port 160 can be observed through a vent hole 118, allowing confirmation of the proper function of the trap primer. In embodiments, flow from the trap primer is about 4.2 ounces per minute. Lowering the cleaning probe allows flow in the start-up condition to resume as shown in FIG. 4.

Figure 8:
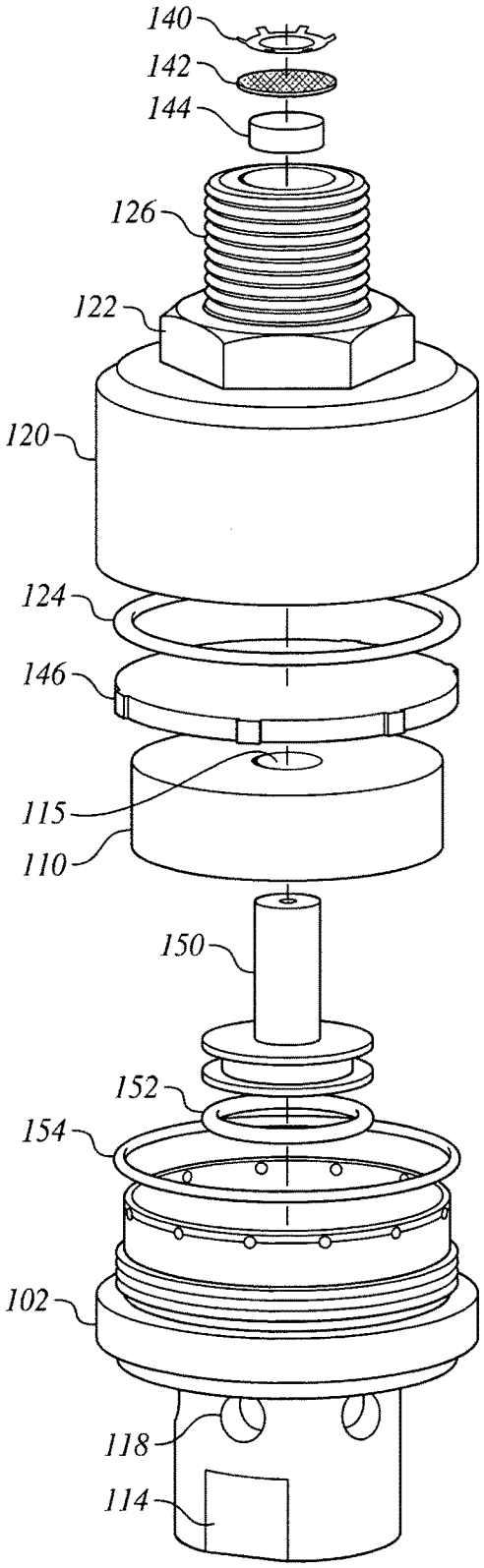
FIG. 8 is an exploded view of the components of an embodiment trap primer without the cleaning lever and probe.

FIG. 8 is an exploded view of the components of an embodiment trap primer. Visible in FIG. 8 is a filter retainer 140 which holds the filter screen 142 in place within the upper body inlet 126. Also visible is the wrench hex 122 on the upper body 120. Also visible is the upper body o-ring 124, diaphragm 146, and the RGE closed-cellular polymer foam ring 110 with center hole 115. Also visible is the valve stem 150, valve stem o-ring 152, and lower body o-ring 154. Also visible is the lower body 102, lower body vent holes 118, and lower body wrench flat 114.

Figure 9:
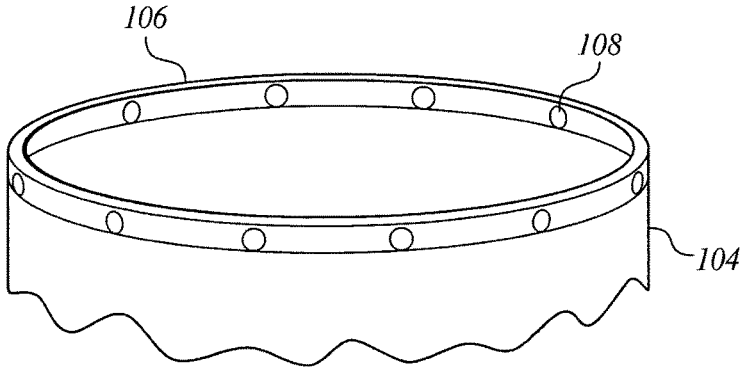
FIG. 9 is a perspective view of the rim of the lower chamber of an embodiment trap primer.

FIG. 9 is a perspective view of the rim of the lower chamber of an embodiment trap primer. Visible in FIG. 9 is the cylindrical lower chamber 104, the lower chamber rim 106 at the top of the lower chamber, and the multiple lower chamber rim openings 108 which arrayed about the circumference of the rim 106.

Figure 10:
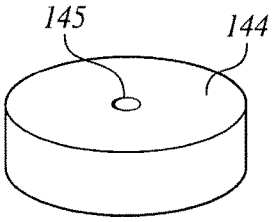
FIG. 10 is a perspective view of the anti-oscillation valve disk.

FIG. 10 is a perspective view of the anti-oscillation valve disk 144. Visible in FIG. 10 is the center orifice 145.

Figure 11:
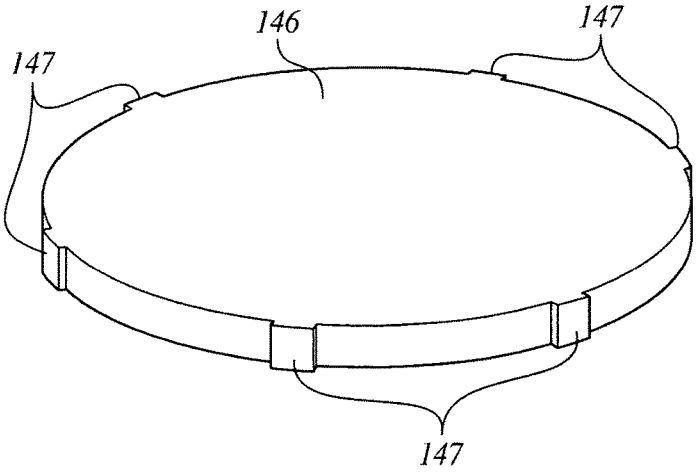
FIG. 11 is a perspective view of the flexible diaphragm.

FIG. 11 is a perspective view of the flexible diaphragm 146. Visible in FIG. 11 are a multiplicity of diaphragm centering tabs 147. In embodiments 6 centering tabs are arrayed about the circumference of the diaphragm.

Figure 12:
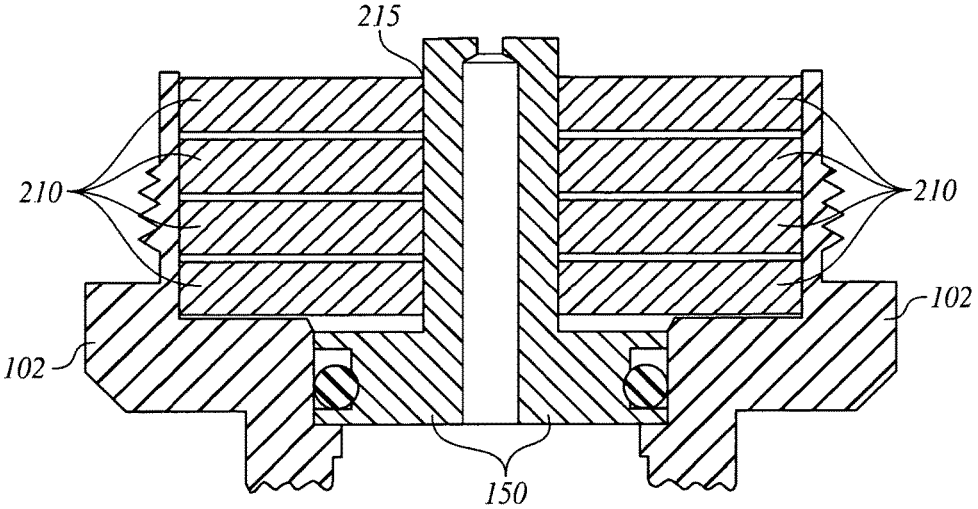
FIG. 12 is cross-sectional view of the embodiment trap primer of FIG. 1 taken at line 2-2 showing the second embodiment foam medium or foam disk located in the lower chamber.

FIG. 12 is cross-sectional view of the embodiment trap primer of FIG. 1 taken at line 2-2 showing the second embodiment RGE polymeric foam medium or foam disk 210 located in the lower chamber 102. The second embodiment polymeric foam medium or foam disk is shaped like a circular disk with a center hole 215. Each foam disk of the second embodiment is thinner than the first embodiment foam rings. The valve stem 150 protrudes through the center hole 215 when the foam disks are installed. In embodiments, 4 foam disks are placed in the lower chamber. The second embodiment polymeric medium is identical to the first embodiment in performance and material of manufacture.

Figure 13:
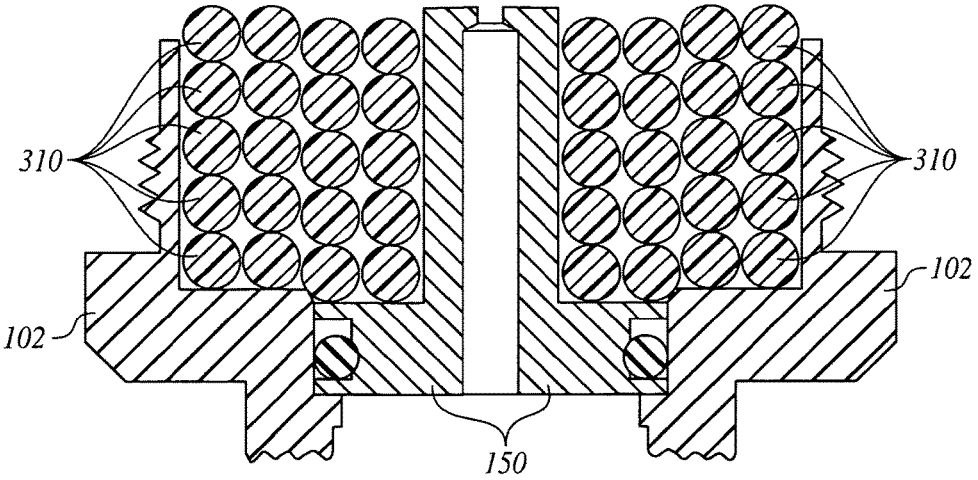
FIG. 13 is cross-sectional view of the embodiment trap primer of FIG. 1 taken at line 2-2 showing the third embodiment foam medium or foam particles located in the lower chamber.

FIG. 13 is cross-sectional view of the embodiment trap primer of FIG. 1 taken at line 2-2 showing the third embodiment RGE polymeric foam medium or foam particles 310 located in the lower chamber 102. The foam particles have a generally spherical form. In embodiments the diameter of the particles have a diameter of approximately 0.25 to 0.5 inches. The third embodiment polymeric medium is identical to the first embodiment in performance and material of manufacture.

Figure 14:
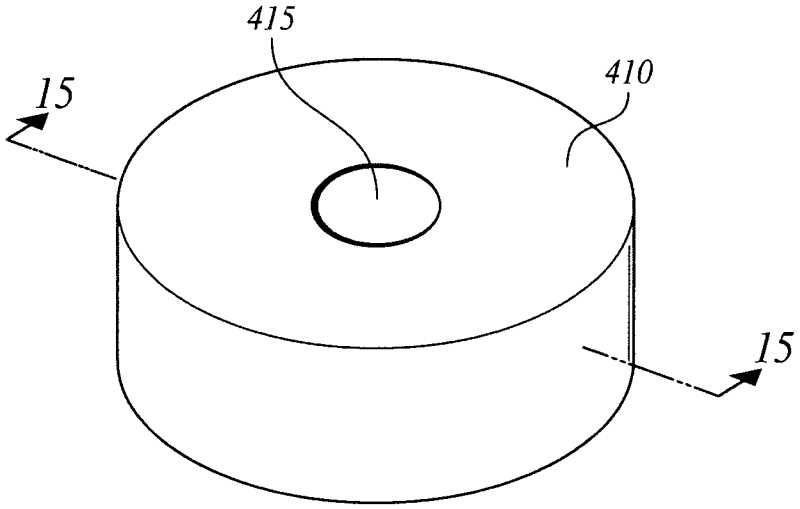
FIG. 14 is a perspective view of the fourth embodiment resilient gas enclosure or bubble chamber.

FIG. 14 is a perspective view of the fourth embodiment resilient gas enclosure or bubble chamber 410. The bubble chamber embodiment has a general donut-shape with a center hole 415.

Figure 15:
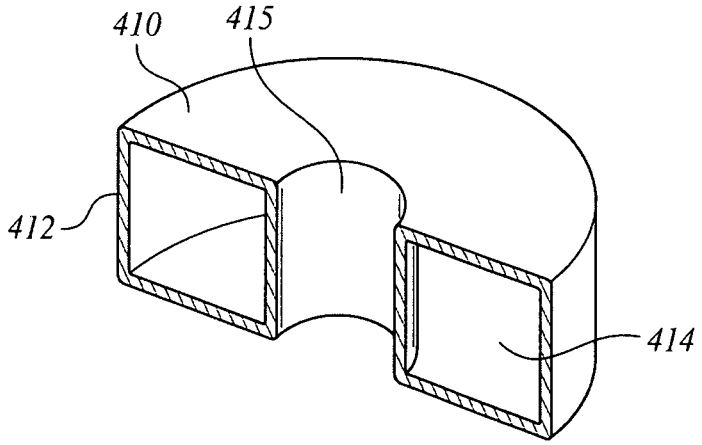
FIG. 15 is a cross sectional view of the fourth embodiment resilient gas enclosure or bubble chamber taken at line 15-15 of FIG. 14.

FIG. 15 is a cross sectional view of the fourth embodiment resilient gas enclosure or bubble chamber 410 taken at line 15-15 of FIG. 14. Visible in FIG. 15 is the chamber wall 412 and chamber lumen 414. The bubble chamber takes the form of a hollow, gas containing sealed structure with impermeable resilient walls made of suitable polymers, such as polyurethane, polyvinyl chloride, polystyrene, polyimide, or silicone and containing in the lumen 414 a gas or gasses such as $CO_2$, $N_2$, or air.

Figure 16:
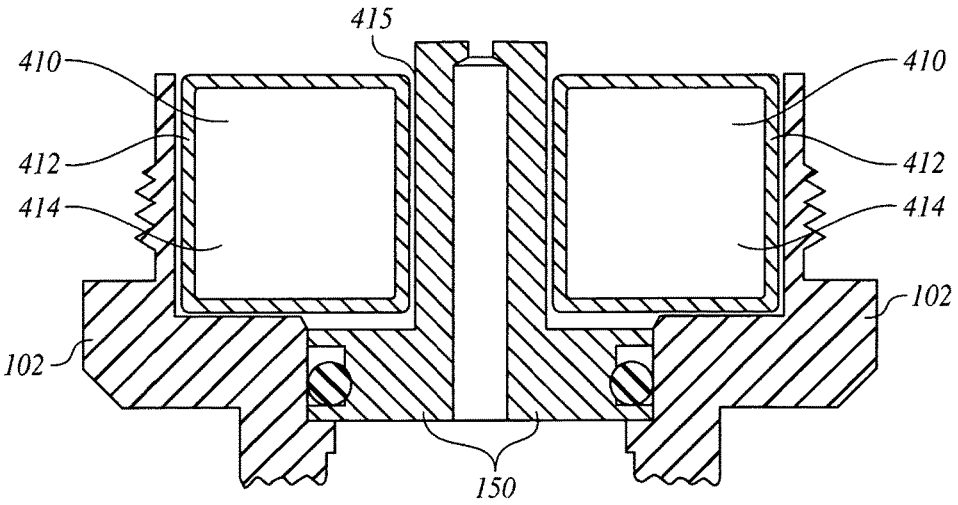
FIG. 16 is a cross-sectional view of the embodiment trap primer of FIG. 1 taken at line 2-2 showing the fourth embodiment resilient gas enclosure or bubble chamber located in the lower chamber.

FIG. 16 is a cross-sectional view of the embodiment trap primer of FIG. 1 taken at line 2-2 showing the fourth embodiment resilient gas enclosure or bubble chamber 410 located in the lower chamber 102. The fourth embodiment medium or bubble chamber is shaped like a circular disk with a center hole 415. The valve stem 150 protrudes through the center hole 415 when the foam disks are installed. Also visible in FIG. 16 is the bubble chamber wall 412 and bubble chamber lumen 414.

Figure 17:
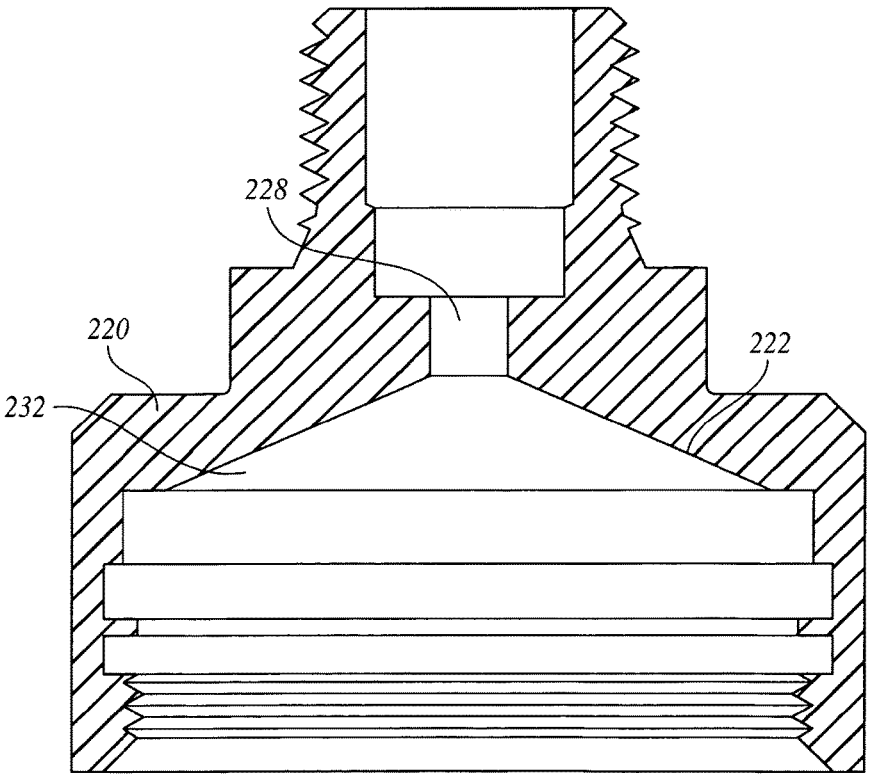
FIG. 17 is a cross-sectional view of the second embodiment cylindrical upper body.

FIG. 17 is a cross-sectional view of the second embodiment cylindrical upper body 220. The second embodiment upper body 220 is identical to the first embodiment upper body 120 with the exception of the upper chamber ceiling 222. In the first embodiment upper body (as in FIG. 2) the upper chamber ceiling 122 is flat. In the second embodiment upper body 220 shown in cross-section in FIG. 17 the upper chamber ceiling 222 slopes upwardly toward the upper body bore 228. The second embodiment cylindrical upper chamber 232 therefore has the form of a cylinder topped by a cone with straight sides. The second embodiment upper body chamber is more sensitive to fluctuations in water pressure than the first embodiment upper body chamber. The second embodiment is particularly suitable for use in installations with relatively low water pressure changes or drops.

The polymeric foam medium in all RGE embodiments except fourth embodiments is manufactured of a closed-cell polymer foam. Such materials comprise independent, non-communicating cells of a resilient polymeric material, such as a polyurethane, polyvinyl chloride, polystyrene, polyimide, or silicone. Cells in the foam are formed during manufacturing using blowing agents, such as $CO_2$, $N_2$, or air. A suitable closed-cell polymer foam is polyurethane with closed cells containing $CO_2$ gas.

The wall material of fourth embodiments RGE is manufactured of polymers such as polyurethane, polyvinyl chloride, polystyrene, polyimide, or silicone. The gas or gasses of the fourth embodiment RGEs such as $CO_2$, $N_2$, or air.

While the RGE of all embodiments may be thought of as a sealed chamber of gas or gasses, it should be noted that it can float freely and, unlike pistons, functions while producing little or no friction. No O-rings or other sealing devices are required. The polymeric foam medium responds and the bubble chamber responds very quickly to any positive or negative changes in inlet pressure. The trap primer has been shown to respond to a pressure drop of less than 0.25 psi.

In embodiments, both the anti-oscillation valve disc and the flexible diaphragm are manufactured of any suitable relatively light, rigid, strong water-resistant material such as ethylene propylene diene monomer (M-class) rubber, a synthetic rubber also called EPDM rubber.

Solid parts of embodiments trap primers are manufactured of any suitable strong, corrosion-resistant material, such as steel, stainless steel, brass, bronze, copper alloys and plastics. In embodiments the valve stem is made of brass.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A trap primer for maintaining water levels in a drain trap in a building having a water supply line comprising:
- a connection to the building water supply line,
- an upper chamber,
- an anti-oscillating valve located between the supply line and the upper chamber, a lower chamber having a bottom and a circumferential upper edge,
- the upper and lower chambers separated by a free floating flexible diaphragm,
- a valve stem extending vertically from the bottom to the upper edge of the lower chamber,
- the valve stem having a bore with an orifice at the upper end, and a port leading to a trap at the lower end,
- the diaphragm reversibly sealing the valve stem orifice, and
- a resilient gas enclosure located in the lower chamber.

2. The trap primer of claim 1 further comprising:
- a test probe and lever.

3. The trap primer of claim 1 further comprising:
- a distributor located between the valve stem port and the trap.

4. The trap primer of claim 1 wherein the resilient gas enclosure is a foam ring.

5. The trap primer of claim 1 wherein the resilient gas enclosure is a foam disk.

6. The trap primer of claim 1 wherein the resilient gas enclosure is a foam particle.

7. The trap primer of claim 1 wherein the resilient gas enclosure is a bubble chamber.

8. The trap primer of claim 1 wherein the upper chamber has the form of a cylinder.

9. The trap primer of claim 1 wherein the upper chamber has the form of a cylinder surmounted by a cone.

10. The trap primer of claim 1 further comprising:
- distributor means for distributing water to at least one drain trap located between the port and the at least one drain trap.

11. The trap primer of claim 10 wherein water is distributed to four drain traps.

12. The trap primer of claim 1 further comprising a cleaning lever and a cleaning probe.

13. The trap primer of claim 1 comprising:
- an inlet bore in the water supply line,
- an inlet bore shoulder,
- a filter screen retained on the bore shoulder,
- an inlet shoulder on the inlet bore below the inlet bore shoulder, and
- an anti-oscillation valve disc resting on the inlet shoulder,
- the anti-oscillation valve disc having a valve disc center orifice.

14. A trap primer for maintaining water levels in a drain trap in a building having a water supply line comprising:
- a connection to the building water supply line via an inlet bore,
- an anti-oscillation valve comprising:
- an inlet bore shoulder,
- a filter screen retained on the bore shoulder,
- an inlet shoulder on the inlet bore below the inlet bore shoulder, and
- an anti-oscillation valve disc resting on the inlet shoulder,
- the anti-oscillation valve disc having a valve disc center orifice,
- an upper chamber,
- an upper body bore between the anti-oscillation valve and the upper chamber,
- a lower chamber having a bottom and a circumferential upper edge,
- the upper and lower chambers separated by a free floating flexible diaphragm,
- an inlet check valve which controls flow of water between the upper and lower chambers,
- a valve stem extending vertically from the bottom of the lower chamber to the upper edge of the lower chamber,
- the valve stem having a bore with an orifice at the upper end, and a valve stem port at the lower end,
- a resilient gas enclosure located in the lower chamber,
- a cleaning probe extending through the valve stem bore,
- a cleaning lever connected to the cleaning probe, an outlet bore below the valve stem port, an outlet distributor comprising:
- a distributor inlet,
- a flow divider,
- four distributor bores, and
- four trap supply outlets.

* * * * *